US008186679B2

(12) United States Patent
Hauge

(10) Patent No.: US 8,186,679 B2
(45) Date of Patent: May 29, 2012

(54) BOARD GAME

(76) Inventor: David Lawrence Hauge, Mercer Island, WA (US)

( * ) Notice: Subject to any disclaimer, the term of this patent is extended or adjusted under 35 U.S.C. 154(b) by 0 days.

(21) Appl. No.: 12/683,432

(22) Filed: Jan. 7, 2010

(65) Prior Publication Data

US 2010/0176551 A1 Jul. 15, 2010

Related U.S. Application Data

(60) Provisional application No. 61/143,769, filed on Jan. 10, 2009.

(51) Int. Cl.
*A63F 3/00* (2006.01)

(52) U.S. Cl. ..... 273/248; 273/249

(58) Field of Classification Search ..... 273/248, 273/249

See application file for complete search history.

(56) References Cited

U.S. PATENT DOCUMENTS 1,506,484 A * 8/1924 Hart ..... 408/114
1,518,306 A * 12/1924 Clegg ..... 273/248
2,343,812 A * 3/1944 Sikora ..... 273/248
2,629,597 A * 2/1953 Lenit ..... 273/244.1
2,756,053 A * 7/1956 Wales ..... 273/258
3,414,264 A * 12/1968 Schriber ..... 273/249
3,741,546 A * 6/1973 Chen ..... 273/249
5,083,794 A * 1/1992 Santagata ..... 273/249
5,362,061 A * 11/1994 Napolitano ..... 273/243
5,433,450 A * 7/1995 Vaillancourt ..... 273/248
5,660,389 A * 8/1997 Freda, III ..... 273/249

* cited by examiner

*Primary Examiner* — Vishu K. Mendiratta

(57) ABSTRACT

A board game 10 comprising a plurality of game pieces 12 in which each group of four game pieces 14 is uniquely color coded and used by one particular player during the game. A board 16 is provided having separate sections 18 with identical layouts for each player, each including starting positions 20, a continuous path of twenty-five numbered field positions 22, and home positions 24. The roll of a die 30 determines how each player moves. On each turn a player may advance one of their own game pieces 12 through their respective quadrant 18 or alternatively knock back one of their opponents' game pieces 12. Also, during play each player has opportunities to position their own game pieces to protect them from being knocked back. Ultimately each player tries to be the first player to successfully move all four of their game pieces 14 from their starting positions 20 to their home positions 24 to win the game.

3 Claims, 5 Drawing Sheets

BOARD GAME

TECHNICAL FIELD

Figure 1:
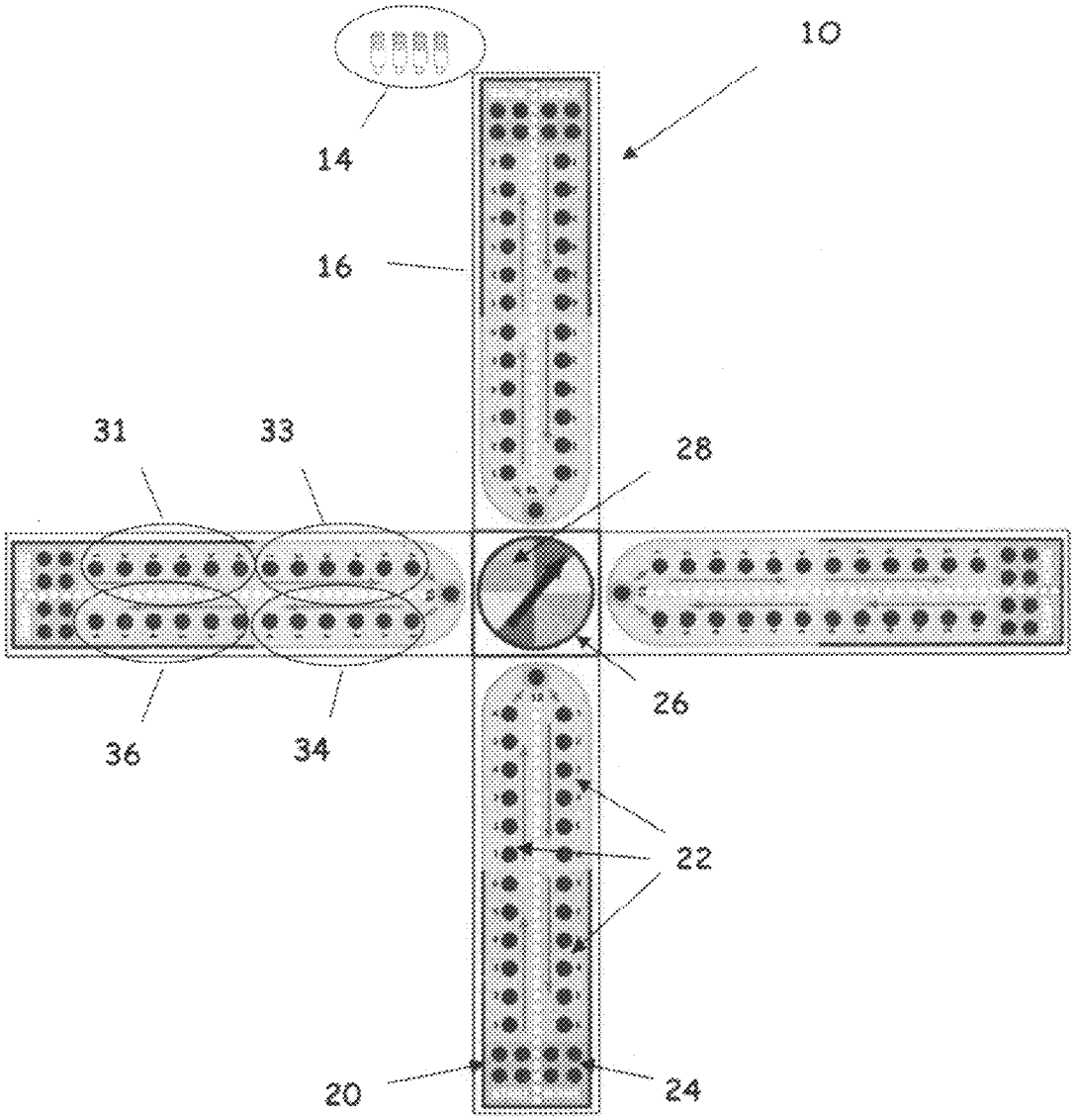

The disclosed subject matter relates generally to board games and more specifically it relates to a board game played by a plurality of players and having substantial tactical component. The descriptions included herein are more generally applicable to situations of four players, but can also be applied to the game being played by two or three players.

BACKGROUND

Board games heretofore devised and utilized are known to consist basically of familiar, expected and obvious structural configurations, notwithstanding the myriad of designs encompassed by known board games, which have been developed for the fulfillment of countless objectives and requirements.

While known games fulfill their respective particular objectives and requirements, they do not disclose the present board game as described and claimed. The presently disclosed device includes a game board 16 comprising a plurality of game pieces 12 in which each group of four game pieces 14 are color coded and used by one particular player during the game. A game board 16 is provided having four separate quadrants 18 with identical layouts, each including four unnumbered starting positions 20, one continuous path of twenty-five numbered field positions 22, numbered sequentially in four groups of six except for one position numbered thirteen, and four unnumbered home positions 24. Each player is uniquely assigned one of the four quadrants. The board also includes a spinner 26 used for each player's turn. Each space 28 on the spinner 26 corresponds to the colors of each player's game pieces 12. The spinner 26 and the roll of a six-sided die 30 determine how each player moves on their respective turn. On each turn, after a spin of the spinner 26 and a roll of the die 30, a player may advance one of their own game pieces 12 through their respective quadrant 18 or alternatively, should the opportunity present itself, knock back one of their opponents' game pieces 12. During play each player, on their respective turns, may have opportunities to position their own game pieces 12 to protect them from being knocked back by the opponents, thereby preserving their own progress.

Ultimately each player tries to be the first player to successfully move all four of their game pieces 14 from their starting positions 20 to their home positions 24 to win the game.

In these respects, the presently disclosed board game substantially departs from the conventional concepts and designs of the known board games, and in so doing provides an apparatus primarily developed for the purpose of providing users with an entertaining and educational game that is fun and challenging for all ages.

SUMMARY

In view of the foregoing disadvantages inherent in the known board games, the present disclosed subject matter provides a new board game construction wherein the same can be utilized for providing users with an entertaining and educational game that is fun and challenging for all ages.

The general purpose of the present disclosed subject matter, which will be described subsequently in greater detail, is to provide a new board game apparatus and method which has many of the advantages of the board games mentioned heretofore and many novel features that result in a new board game which is not anticipated, rendered obvious, suggested, or even implied by any known board games, either alone or in any combination thereof.

To attain this, the present disclosed subject matter generally comprises a game board 16 comprising a plurality of game pieces 12 in which a group of four of the game pieces 14 are color coded and used by one particular player during the game. A board is provided having four separate quadrants 18 with identical layouts, each including four unnumbered starting positions 20, one continuous path of twenty-five numbered field positions 22, numbered sequentially in four groups of six except for one position numbered thirteen, and four unnumbered home positions 24. Each player is uniquely assigned one of the four quadrants 18. The board also includes a spinner 26 used for each player's turn. The spaces 28 on the spinner 26 each correspond to the colors of each player's game pieces 12. The spinner 26 and the roll of a six-sided die 30 determine how each player moves on their respective turn. On each turn, after a spin of the spinner 26 and a roll of the die 30, a player may advance one of their own game pieces 12 through their respective quadrant 18 or alternatively, should the opportunity present itself, knock back one of their opponents' game pieces 12. During play each player, on their respective turns, may have opportunities to position their own game pieces 12 to protect them from being knocked back by the opponents, thereby preserving their own progress. Ultimately each player tries to be the first player to successfully move all four of their game pieces 12 from their starting positions 20 to their home positions 24 to win the game.

There has thus been outlined, rather broadly, the more important features of the disclosed subject matter in order that the detailed description thereof that follows may be better understood, and in order that the present contribution to the art may be better appreciated. There are additional features of the disclosed subject matter that will be described hereinafter and which will form the subject matter of the claims appended hereto.

In this respect, before explaining at least one embodiment of the disclosed subject matter in detail, it is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosed subject matter. It is important, therefore, that the claims be regarded as including such equivalent constructions insofar as they do not depart from the spirit and scope of the present disclosed subject matter.

It is therefore an object of the present disclosed subject matter to provide a new board game apparatus and method which has many of the advantages of the board games mentioned heretofore and many novel features that result in a new board game which is not anticipated, rendered obvious, suggested, or even implied by any of the prior art board games, either alone or in any combination thereof.

Another object is to provide a board game that combines chance, strategy, risk taking and rivalry that can be played by both young and old players.

Another object is to provide a board game that while being relatively simple in its design is also extremely engaging for players of all ages.

Another object is to provide a game that is extremely fun and will keep its players busy and amused for long periods of time.

Another object is to provide younger players a board game that includes practice in counting numbers on a die as well as numbers on the board.

Another object is to provide younger players a board game that includes decision making opportunities.

Another object is to provide players a board game that includes strategy development.

Another object is to provide a board game that is economical in cost to manufacture.

Another object is to provide a new board game which is of a durable and reliable construction.

Further objects of the present disclosed subject matter will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Further, the purpose of the foregoing summary is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The summary is neither intended to define the invention of the application, which is measured by the claims, nor is it intended to be limiting as to the scope of the disclosed subject matter in any way.

Figure 2:
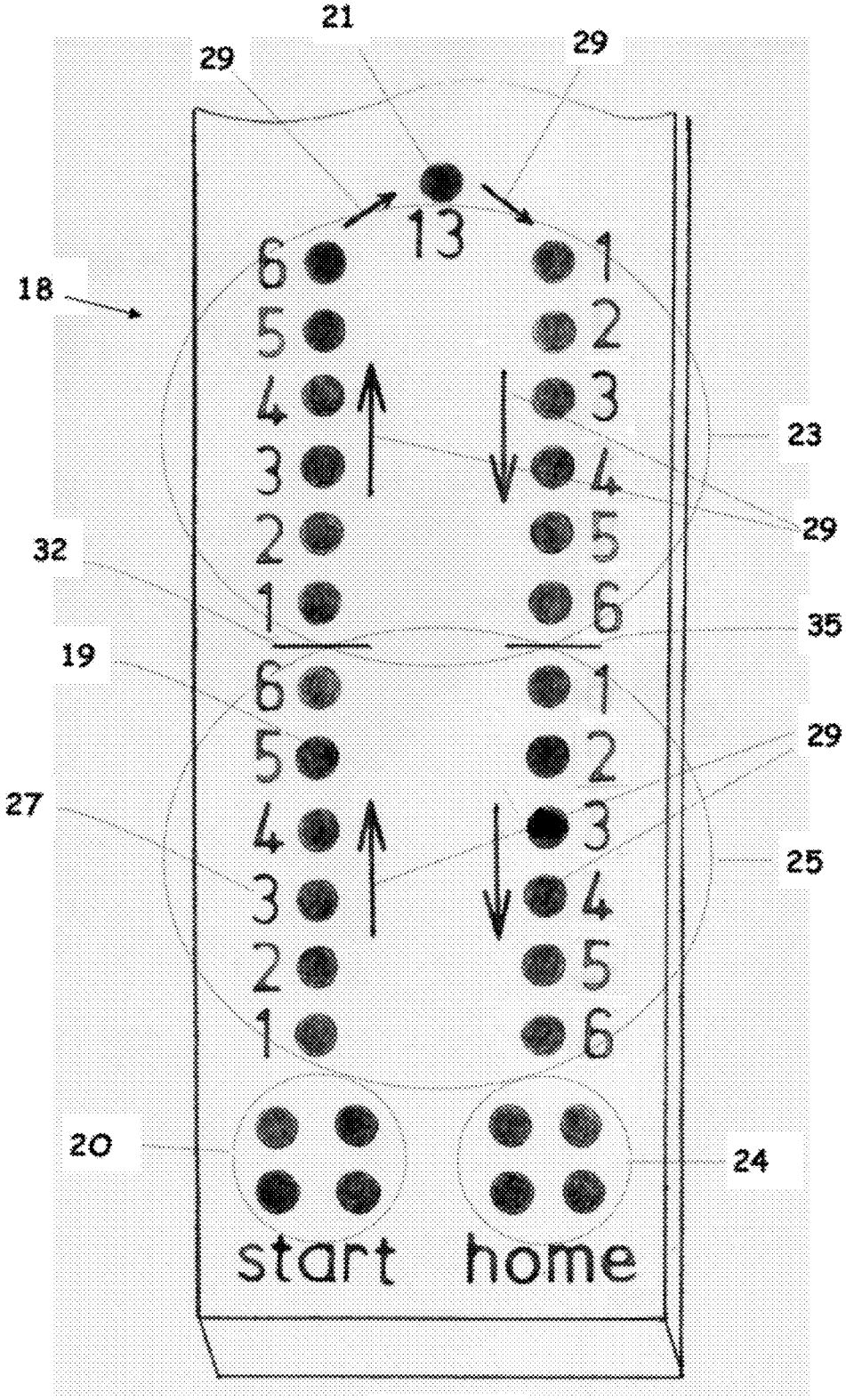
Figure 3:
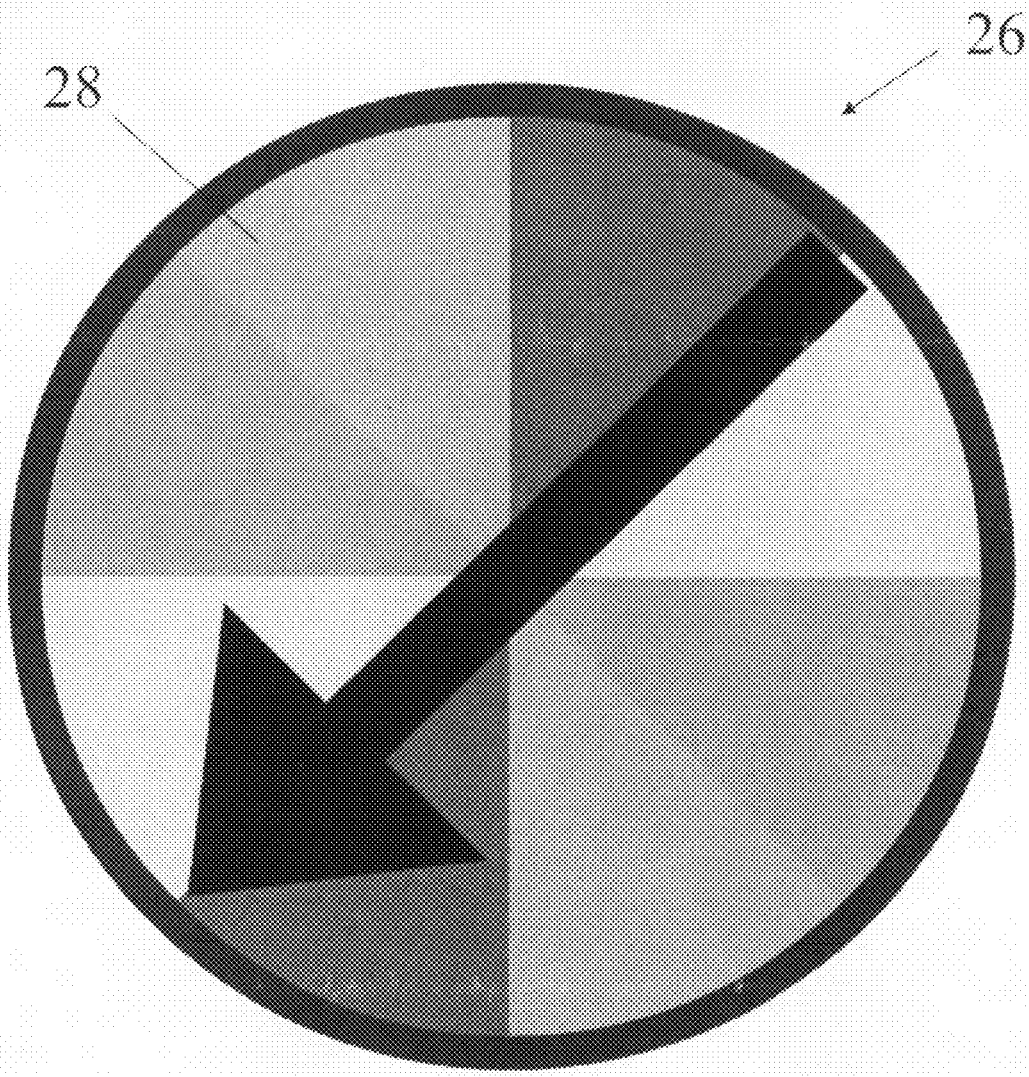
Figure 4:
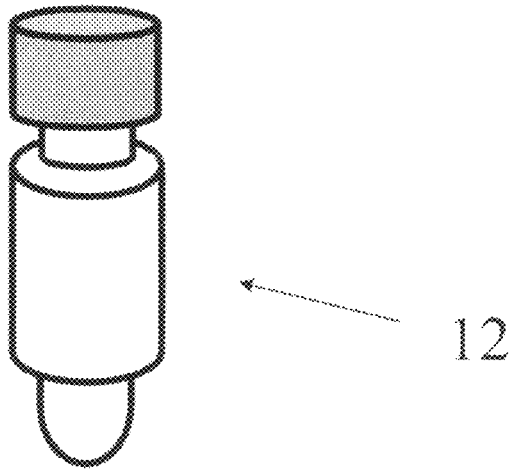
Figure 5:
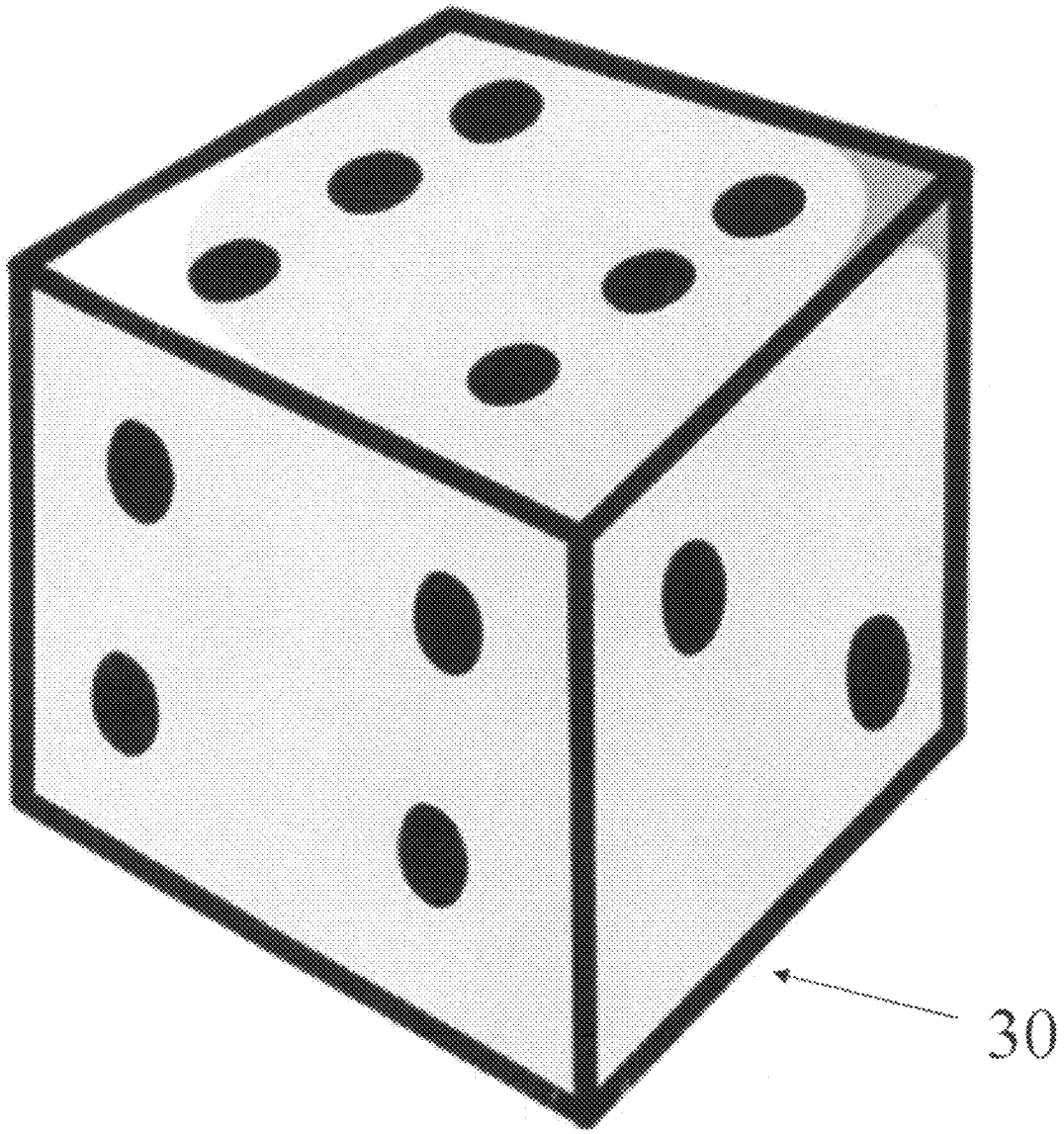

DESCRIPTION OF THE DRAWINGS a. FIG. 1 shows an exemplary embodiment of the presently disclosed board game;

b. FIG. 2 shows a view of one of four quadrants of a board of the board game shown in FIG. 1;

c. FIG. 3 shows a view of a spinner of the board game shown in FIG. 1;

d. FIG. 4 shows a game piece of the board game shown in FIG. 1;

e. FIG. 5 shows a standard six-sided die of the board game shown in FIG. 1.

LIST OF REFERENCE NUMERALS IN THE DRAWINGS

| | |
|---|---|
| 10 | Board game |
| 12 | Game piece |
| 14 | Four game pieces in a group |
| 16 | Game board |
| 18 | Close up view of one of the four identical quadrants |
| 19 | One of the twenty-five field positions in a row |
| 20 | Four starting positions |
| 21 | Thirteenth field position |
| 22 | Continuous path of twenty-five field positions in a row |
| 23 | Protected area |
| 24 | Four home positions |
| 25 | Unprotected area |
| 26 | Spinner |
| 27 | Field position number |
| 28 | Spinner colored space |
| 29 | Directional arrow |
| 30 | Standard six-sided die |

-continued

LIST OF REFERENCE NUMERALS IN THE DRAWINGS

| | |
|---|---|
| 31 | First set of six field positions within one quadrant |
| 32 | Line separating the first and second set of six field positions |
| 33 | Second set of six field positions within one quadrant |
| 34 | Third set of six field positions within one quadrant |
| 35 | Line separating the third and fourth set of six field positions |
| 36 | Fourth set of six field positions within on quadrant |

DETAILED DESCRIPTION

The present invention discloses a board game 10 in which two to four players compete to move their respective four game pieces 14 from starting positions 20, along a path of twenty-five pre-designated field positions 22, to home positions 24. The winner is the player who first successfully advances all four of their game pieces 14 from their starting positions 20 to their home positions 24. The descriptions included herein are more generally applicable to situations of four players, but can also be applied to the game being played by two or three players.

Turning to FIG. 1, a first embodiment of the game includes a game board 16, shown as a crisscross-shaped surface having markings thereon to demark game piece 12 positions. Of course, other shapes of the game board 16 can be utilized, such as rectangular or square configurations suitable for use by two to four players.

The field positions 22 in the board surface preferably are shaped to receive correspondingly shaped game pieces 12. In this embodiment the field positions 19 are round holes and the game pieces 12 are round pegs that fit securely into the holes. In alternate embodiments, the field positions 19 could be circular depressions in the board and the game pieces 12 correspondingly-sized round objects such as marbles. In yet another embodiment the field positions 19 could be flat spaces and the game pieces 12 correspondingly-sized objects that rest firmly on the filed positions 19. There are a number of alternatives for the field positions 19 and the game pieces 12, all having the object of preserving positional retention of the game pieces and allowing the game board 16 to weather minor jostling without the need to begin the game anew, and thereby creating a stable environment on which the game can be played.

In this embodiment the game pieces 12 are round pegs that fit snugly into the round holes of the game board 16, of a size easy for the players to handle as they move the game pieces 12 around the board. The game pieces 12 are colored for easy identification. There are sixteen game pieces 12 in total, including four sets of four game pieces 14, each set of four game pieces 14 uniquely colored from the other four sets of four game pieces 14 such that all players can readily differentiate the colors of the game pieces 12. For example, the could be four red game pieces 14, four blue game pieces 14, four green game pieces 14 and four yellow game pieces 14.

The board 10 is divided up into four quadrants 18 plus a center area for the spinner 26.

As best shown in FIG. 2, each quadrant 18 contains the starting positions 20, numbered 27 field positions 19 and home positions 24 used by that quadrant's 18 respective player. Each quadrant 18 is identical from the perspective of each player.

In each quadrant 18, the respective player has a set of four starting positions 20, twenty-five numbered 27 field positions 22, and four home positions 24. Each quadrant's 18 four starting positions 20 are clustered and are not numbered. Each quadrant's 18 four home positions 24 are clustered and are not numbered. Each quadrant's 18 twenty-five numbered field positions 22 are in a row first moving away from the player, then pivoting half way, then moving back toward the player. Referring to FIGS. 1 and 2, each quadrant's 18 twenty-five field positions 22 are numbered 27 as follows:

The first six field positions (the "first set") 31 are numbered 27 sequentially from one to six.

The next six field positions (the "second set") 33 are numbered 27 sequentially from one to six.

The next one field position is numbered 27 thirteen (the "thirteenth field position") 21.

The next six field positions (the "third set") 34 are numbered 27 sequentially from one to six.

The next six field positions (the "fourth set") 36 are numbered 27 sequentially from one to six.

In each quadrant 18 a line 32 separates the first set 31 from the second set 33, and a line 35 separates the third set 34 from the fourth set 36. The lines 32 35 delineate the protected area 23 from the unprotected area 25. In each quadrant 18 the second set 33 and the third set 34 are in the area of the quadrant 18 designated as the protected area 23. The first set 31 and fourth set 36 are in the area of the quadrant 18 designated as the unprotected area 25.

Referring again to FIG. 1 in the disclosed embodiment, in the center of the board is the spinner 26. As best shown in FIG. 3, the spinner 26 is used by each player to randomly determine a color for each of their turns as explained further below. In alternate embodiments, a specially designed deck of playing cards having an equal number of cards representing each of the four colors of the game pieces could be used. There are a number of alternatives that could be used for the random generation of the color to be used for each player's turn, all having the object of providing an equal chance of selection of one of the four game piece 12 colors, thereby creating a sense of excitement and chance during each player's turn during play of the game.

Playing Methods

There are two primary ways to play the board game 10, each of which is equally challenging and engaging for the players. Directly below is a description of two exemplary playing methods in as far as the two playing methods are different. Following that is further description of the game that is relevant to both playing methods. The two playing methods are very similar with only certain rules being different. In both playing methods the ultimate goal of trying to be the first player to successfully move all four of their game pieces 14 from their starting positions 20 to their home positions 24 to win the game is the same, and the chances, strategies, risks and rivalries encountered are nearly identical. It is primarily the mechanics of the game that differ slightly between the two playing methods.

First Exemplary Playing Method

The game is for two or more players. The description of this exemplary playing method assumes that there are four players playing.

Each player has four game pieces 14 of the same color. Each player is identified by the color of their game pieces 14. To start the game each player begins with all four game pieces 14 in their respective starting positions 20.

The first player rolls a die 30 and moves one of their game pieces 12 out of its starting position 20 the number of field positions 19 as rolled on the die 30, moving along in the first set of field positions 31 within their respective quadrant 18 in the direction of the directional arrows 29.

Now it is the second player's turn. The second player spins the spinner 26 to determine which of the other three players is their target opponent for their current turn. The colored space 28 on which the spinner 26 stops determines which of the other players will be the second player's target opponent for that turn. For example, if the spinner 26 stops on a blue space 28, the blue player will be the second player's target opponent for that turn. If the spinner 26 lands on the second player's own color, the second player chooses one of the other players to be their target opponent for that current turn. Once the second player's target opponent is identified for that current turn, the second player rolls the die 30. The second player has an opportunity to send their target opponent's game piece 12 back to its starting position 20 if the target opponent has one of their game pieces 12 in a field position 19 numbered 27 the same as the number rolled on the die 30. If the target opponent does not have one of their game pieces 12 in a field position 19 numbered 27 the same as the number rolled on the die 30, or if the second player instead desires to advance their own game pieces 12, the second player moves one of their own game pieces 12 the number of field positions as rolled, moving along in the first set of field positions 31 within their respective quadrant 18 in the direction of the directional arrows 29.

Next the third and then the fourth players repeat the activities of the second player as described in the paragraph above, however moving their own game pieces 12 within their own quadrants 18, or alternatively sending back to its starting position 20 that player's target opponent's game piece 12. On their respective turns the third and fourth players determine their respective target opponents based on their respective spins of the spinner 26 on their respective turns.

(Next: see "Playing Method Continued—Common to First and Second Exemplary Playing Methods")

Second Exemplary Playing Method

The game is for two or more players. The description of this exemplary playing method assumes that there are four players playing.

Each player has four game pieces 12 each of different color. To start the game each player begins with all four game pieces 14 in their respective starting positions 20. Each player chooses the order of their game pieces 12 in the starting positions 20.

The first player rolls a die 30 and moves any one of their colored game pieces 12 out of its starting position 20 the number of field positions as rolled on the die 30, moving along in the first set of field positions 31 in the direction of the directional arrows 29 within their respective quadrant 18.

Now it is the second player's turn. The second player spins the spinner 26 to determine a target color 28 for that turn, and then rolls the die 30. The second player has an opportunity to send any of their three opponent's game pieces 12 back to its starting position 20 if any one of those opponents has one of their game pieces 12 in a field position 19 that's number 27 both matches the number rolled by the second player and matches the target color that was spun by the second player. For example, if the second player's spin stops on a blue space 28, and the second player rolls a six, if any one of the other three players has a blue colored game piece 12 in a field position 19 numbered 27 six, the second player can chose to send that game piece 12 back to the respective player's starting positions 20. If none of the three opponents have a game piece 12 in a field position 19 numbered 27 that matches the number rolled and is also the target color, or if the second player instead desires to advance their own game pieces 12, the second player then moves any one of their own game pieces 12 the number of field positions 19 as rolled, moving along in the first set of field positions 31 within their respective quadrant 18 in the direction of the directional arrows 29.

Next the third and then the fourth players repeat the activities of the second player as just described in the paragraph above, however moving their own game pieces 12 within their own quadrants 18, or sending back to its starting position 20 an opponent's game piece 12 if that opportunity arises based on the roll of the die 30 and the target color spun by each respective player on their respective turn.

(Next: see "Playing Method Continued—Common to First and Second Exemplary Playing Methods")

Playing Method Continued—Common to First and Second Exemplary Playing Methods

The play continues with players one through four taking their respective turns. Starting with each player's second turn and with all subsequent turns, each player has the opportunity to move their game pieces 12 sequentially along in the first set of six field positions 31, then along in the second set of six field positions 33, then along in the thirteenth field position 21, then along in the third set of six field positions 34, then along in the fourth set of six field positions 36, then along into one of the four home positions 24, all directions being indicated by the directional arrows 29 on the board 16. Thereby, incrementally turn by turn, each player is trying to move all of their own four game pieces 14 from their starting positions 20, through all of their respective quadrant's 18 twenty-five field positions 22, to their quadrant's 18 home positions 24.

Each player can move their game pieces 12 in whatever manner of sequence desired to match the strategy employed by the player. Each player can have up to all four of their game pieces 12 in their respective quadrant's 18 field positions 19 during the game.

A player may not skip a turn unless it is not possible to move a game piece 12 or send an opponents game piece 12 back. In each turn a player must take some action either involving one of their own game pieces 12 or one of their opponent's game pieces 12, the former action being moving their game piece 12 forward through the field positions 22 the number rolled on the die 30, and the latter action being sending their opponent's game piece 12 back to its starting position 20.

Therefore in each of their turns a player must decide whether to move one of their game pieces 12 along the field positions 22 toward or into a home position 24, or to send back an opposing player's game piece 12 to its starting position 20 if the combination of the spin of the spinner 26 and the roll of the die 30 presents such an opportunity as described above. Thus each player may likely develop and employ a strategy of moving their own game pieces 12 aggressively toward the home positions 24 or sending back the opposing player's game pieces 12, depending on the respective positions of all the player's game pieces 12 relative to the ultimate goal of being the first player to have all four of their game pieces 14 safely in the four home positions 24.

As previously described, each quadrant 18 has twenty-five field positions 22. The thirteenth field position 21 of each quadrant 18 has great significance. The first great significance of the thirteenth field position 21 is that, because it is numbered 27 thirteen, a game piece 12 in this field position 21 cannot be sent back to a starting position 20 by an opposing player. Thirteen will never match the roll of the six-sided die 30. The second great significance of the thirteenth field position 21 is that, when it is occupied by a player's game piece 12, it serves to protect all of that player's other game pieces 12 that are in the protected area 23. In aggregate that is the special designation given to the thirteenth field position 21. It is both protected from an opposing player's role of the die 30, and is the protector of the player's other game pieces 12 within the protected area 23. The protected area 23 is the quadrant's 18 second set of six field positions 33 and third set of six field positions 34. On the game board 16 the protected area 23 is separated from the unprotected area 25 by two lines 32, 35, one line 32 being between the first set 31 and second set 33 of field positions and the other line 35 being between the third set 34 and fourth set 36 of field positions.

Given the thirteenth field position's 21 special designation as described above, a player may employ a strategy of placing priority on getting one of their game pieces 12 into the thirteenth field position 21. Having a game piece 12 in the thirteenth field position 21 can create an advantage for the player over their opponents given the protections that arise in this situation as described above. Further, given the advantages gained by having a game piece 12 in the thirteenth field position 21, a player may choose to leave their game piece 12 in the thirteenth field position 21 during the game as long as the protections are of value. The protections would be of value during the periods of the game when the player has a game piece 12 or multiple game pieces 12 moving toward or within the protected area 23. Secondly, the protections may also be of value when the player is trying to avoid having the game piece 12 that is occupying the thirteenth field position 21 be sent back to its starting position 20 by an opposing player. However, this second protection may not be of value if the player has advanced all of their other three game pieces 12 to the home positions 24, and therefore is trying to advance their fourth game piece 12 to the home positions 24 to win the game.

During the game players advance their game pieces 12 along through their respective quadrant's 18 twenty-five field positions 22 and finally into the home positions 24 as described above. When advancing a game piece 12 from the quadrant's fourth set of field positions 36 into a home position 24, the player is required to roll the die 30 the exact number matching the number of field positions that the game piece must advance to reach the home positions 24. If the number rolled is less than the number of field positions 19 between the current field position 19 of the game piece 12 and the home positions 24 the player can advance the game piece 12 toward the home positions 24. However, if the number rolled is greater than one more than the number of field positions 19 between the current field position 19 of the game piece 12 and the home positions 24 the player cannot advance the game piece 12. In other words, the player must roll the exact number to move the game piece into the home position 24. The game ends when a player is the first to successfully advance all four of their game pieces 14 to their home positions 24, thus winning the game.

Alternatively, when advancing into a home position 24 the player is not required to roll the exact number matching the number of field positions 19 that the game piece 12 must advance to reach the home positions 24. Rather, the player is required only to roll at least the number matching the number of field positions 19 that the game piece 12 must advance to reach the home positions 24. This alternative rule normally provides for a more rapid conclusion of the game because it normally allows the players to safely advance their game pieces 12 into the home positions 24 more expeditiously with less chance of being sent back to the home position by an opponent.

Having described and illustrated the principles of the disclosed subject matter in a preferred embodiment thereof, it should be apparent that the disclosed subject matter can be modified in arrangement and detail without departing from such principles. I claim all modifications and variation coming within the spirit and scope of the following claims, including those that would be an electronic version of this game played using a computer or computers or some other electronic device or devices.

The invention claimed is:

1. A board game comprising a game board, a plurality of game pieces, a randomizer, and a six-sided die, the game board comprising of plurality of identical game paths, each path comprising of four starting positions, four home positions, and twenty five intervening positions forming a single file line between the starting and home positions, with twenty four of the intervening positions divided into four groups of six, with each group of six positions being individually and sequentially numbered from one to six that permit the positions to be associated with the numbers on the six-sided die, and one of the intervening positions located between the second and third groups of six positions being unnumbered and therefore not associated with the numbers on the six-sided die, the plurality of game pieces being in sets of four pieces each with each set of four being of the same color but distinct from the colors of the other sets of four game pieces, the randomizer comprising of a plurality of colors each associated with a color of one of the sets of four game pieces, it being capable of randomly selecting one of the plurality of colors when activated, the six-sided die being individually and uniquely numbered on each side from one to six, wherein the board game is operable to be used by two or more players to take turns to roll the die and to activate the randomizer to determine how many positions to move their respective game pieces along their respective game paths on each respective turn, and optionally select an opponent's game piece to send back to its starting position on each turn by matching numbers on the rolled die with numbers of occupied board positions in an opponent's game path and also matching the color selected by the randomizer to the opponent's color, with the ultimate end goal of each player to successfully move all four of his game pieces from his path's four starting positions, through his twenty five intervening positions, to his path's four home positions before any of his opponents do so in their respective game paths.

2. The board game according to claim 1 wherein each of the two or more players initiates his respective turns with a roll of the die and activation of the randomizer, wherein the roll of the die determines how many positions the player may advance one of his four game pieces along the game path starting from the starting positions, progressing through the intervening twenty five intervening positions, and into the four home positions, and optionally wherein the roll of the die and the activation of the randomizer determines which of the player's opponent's game pieces may be sent back to its home position by virtue of matching the color selected by the randomizer to the color of the opponent's game pieces and also matching the number rolled on the die with the number corresponding to the position occupied by the same opponent's game piece at that moment, thereby establishing a decision making opportunity for each player on each turn depending on the outcome of the combination of the roll of the die and activation of the randomizer, each player weighing the option to advance his own game piece or to send back his opponent's game piece, strategically working toward the ultimate goal of advancing his four game pieces to the four home positions before his opponents do so to win the game.

3. The board game according to claim 2 wherein the unnumbered position located between the second and third groups of six positions in each game path is a safe position when occupied by a player's game piece during play because it is not numbered from one to six and therefore cannot be sent back to the starting position by the opponent's roll of the die and activation of the randomizer, and further that unnumbered position when occupied by a player's game piece transforms all twelve of the numbered positions in the adjacent second and third groups of six positions in its game path into protected positions so that any piece occupying one of such twelve positions cannot be sent back to the starting positions by the opponent's roll of the die and activation of the randomizer, thereby achieving a sequential series of thirteen positions in which a player can strategically accumulate and protect one or more game pieces while strategically positioning and advancing toward the ultimate goal of the four home positions without risk of being sent back to the starting positions by an opponent, while also at the same time strategizing on the best opportunities to take risks of moving pieces beyond the thirteen protected positions, thereby being exposed to the risks of being sent back to the starting position by an opponent before successfully advancing into the ultimate goal of the four home positions, all this thereby creating an entertaining environment of chance, decision making, strategizing and risk taking.

* * * * *